US011592151B2

(12) United States Patent
Klus

(10) Patent No.: US 11,592,151 B2
(45) Date of Patent: Feb. 28, 2023

(54) CUSTOMIZABLE LED LIGHTING FIXTURE USING EXTRUSIONS

(71) Applicant: KLUS, LLC, Vero Beach, FL (US)

(72) Inventor: Sylwester Klus, Kamionka (PL)

(73) Assignee: KLUS, LLC, Vero Beach, FL (US)

( * ) Notice: Subject to any disclaimer, the term of this patent is extended or adjusted under 35 U.S.C. 154(b) by 0 days.

(21) Appl. No.: 17/367,939

(22) Filed: Jul. 6, 2021

(65) Prior Publication Data

US 2022/0049823 A1 Feb. 17, 2022

Related U.S. Application Data

(63) Continuation-in-part of application No. 29/760,835, filed on Dec. 4, 2020, and a continuation-in-part of application No. 29/760,833, filed on Dec. 4, 2020.

(30) Foreign Application Priority Data

Aug. 17, 2020 (EM) ..... 008123244-0013
Aug. 17, 2020 (EM) ..... 008123244-0014

(51) Int. Cl.
*F21S 4/28* (2016.01)
*F21V 21/08* (2006.01)
*F21Y 115/10* (2016.01)

(52) U.S. Cl.
CPC ..... *F21S 4/28* (2016.01); *F21V 21/08* (2013.01); *F21Y 2115/10* (2016.08)

(58) Field of Classification Search
CPC .... F21S 4/22; F21S 4/28; F21V 21/08; F21V 15/013
See application file for complete search history.

(56) References Cited

U.S. PATENT DOCUMENTS

| | | | |
|---|---|---|---|
| 5,160,202 | A | 11/1992 | Legare |
| 5,481,443 | A | 1/1996 | Wagner et al. |
| 5,810,468 | A | 9/1998 | Shimada |
| 6,354,714 | B1 | 3/2002 | Rhodes |
| 6,481,130 | B1 | 11/2002 | Wu |
| 6,561,690 | B2 | 5/2003 | Balestriero |
| 7,553,042 | B2 | 6/2009 | Hagen |

(Continued)

FOREIGN PATENT DOCUMENTS

| | | | | |
|---|---|---|---|---|
| EP | 2162674 B1 | | 4/2017 | |
| KR | 101406244 B1 | | 6/2014 | |
| WO | WO-2012122511 A | * | 9/2012 | ..... F21K 9/232 |

*Primary Examiner* — Karabi Guharay
(74) *Attorney, Agent, or Firm* — Mark Terry

(57) ABSTRACT

A custom LED lighting fixture system has a planar opaque top element and an opposing planar translucent bottom element that can be custom fabricated to take any number of shapes. Upon fabrication of the top and bottom elements into an irregular circumferential shape, for example, a first aluminum extrusion is fitted to the left side, and a second aluminum extrusion is fitted to the left side. The first and second extrusions adapt to the shapes of the top and bottom elements. The extrusions comprise a first channel on the interior surface configured to accept the top element, and a second channel configured to accept the bottom element. A first end cap couples to a first end of the first and second extrusions. A second end cap couples to a second end of the first and second extrusions. An LED strip is operational on an interior surface of the top element.

18 Claims, 6 Drawing Sheets

(56) References Cited

U.S. PATENT DOCUMENTS

| | | | |
|---|---|---|---|
| 7,658,509 | B2 | 2/2010 | Summers et al. |
| 7,673,841 | B2 | 3/2010 | Wronski |
| 8,231,243 | B1 | 7/2012 | Boissevain et al. |
| 8,267,540 | B2 | 9/2012 | Klus |
| 8,439,531 | B2 | 5/2013 | Trott et al. |
| 8,459,824 | B1 | 6/2013 | Esmailzadeh |
| 8,616,757 | B2 | 12/2013 | Leadford et al. |
| 8,628,212 | B2 | 1/2014 | Klus |
| 8,651,689 | B2 | 2/2014 | Que |
| 8,764,220 | B2 | 7/2014 | Chan et al. |
| 8,888,306 | B2 | 11/2014 | Thomas et al. |
| 9,222,654 | B2 | 12/2015 | Boyer et al. |
| 9,261,270 | B2 | 2/2016 | Ruud et al. |
| 9,261,271 | B2 | 2/2016 | Kinnune et al. |
| 9,279,544 | B1 | 3/2016 | Dankelmann et al. |
| 9,404,634 | B2 | 8/2016 | Wilcox et al. |
| 9,464,791 | B2 | 10/2016 | May |
| 9,512,984 | B2 | 12/2016 | Tessnow et al. |
| 9,933,123 | B2 | 4/2018 | Ladstätter |
| 9,952,372 | B2 | 4/2018 | Wilcox et al. |
| 10,151,435 | B2 | 12/2018 | Pearson et al. |
| 10,180,220 | B2 | 1/2019 | Eddins |
| 10,295,159 | B2 | 5/2019 | McCarthy et al. |
| 10,393,360 | B2 | 8/2019 | Bailey et al. |
| 10,465,864 | B2 | 11/2019 | Leichner |
| 10,724,719 | B1 | 7/2020 | Heredia |
| 10,955,604 | B2 | 3/2021 | Vasylyev |
| 2003/0021116 | A1 | 1/2003 | Miller |
| 2009/0168419 | A1 | 7/2009 | Daimon |
| 2011/0286207 | A1 | 11/2011 | Chan et al. |
| 2013/0308303 | A1 | 11/2013 | Greenholt et al. |
| 2014/0226316 | A1 | 8/2014 | Medendorp, Jr. et al. |
| 2016/0076746 | A1 | 3/2016 | Porciatti |
| 2017/0205567 | A1 | 7/2017 | Tarsa et al. |
| 2018/0059318 | A1* | 3/2018 | Nichol ..... F21K 9/65 |
| 2018/0245754 | A1 | 8/2018 | Gensler et al. |
| 2018/0259142 | A1 | 9/2018 | Eddins |
| 2018/0306413 | A1* | 10/2018 | Tremaine ..... F21V 31/04 |

* cited by examiner

CUSTOMIZABLE LED LIGHTING FIXTURE USING EXTRUSIONS

CROSS-REFERENCE TO RELATED APPLICATIONS

This patent application is also a continuation in part of, and claims priority to, U.S. patent application Ser. No. 29/760,833 filed Dec. 4, 2020, which claims priority to foreign patent application 008123244-0013 filed Aug. 17, 2020 with the European Intellectual Property Office. This patent application is also a continuation in part of, and claims priority to, U.S. patent application Ser. No. 29/760,835 filed Dec. 4, 2020, which claims priority to foreign patent application 008123244-0014 filed Aug. 17, 2020 with the European Intellectual Property Office. The subject matter of U.S. patent application Ser. Nos. 29/760,833, 29/760,835 and foreign patent application numbers 008123244-0013, 008123244-0014 are herein incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The claimed subject matter relates to home furnishings and equipment, and more specifically relates to lighting fixtures.

BACKGROUND

The following background information presents examples of specific aspects of the prior art (e.g., without limitation, approaches, facts, or common wisdom) that, while expected to be helpful to further educate the reader as to additional aspects of the prior art, is not to be construed as limiting the claimed embodiments, or any embodiments thereof, to anything stated or implied therein or inferred thereupon.

A lighting fixture, or luminaire, is an electrical device containing an electric lamp that provides illumination. Lighting fixtures have a fixture body and one or more lamps. In the case of light-emitting diode (LED) fixtures, the lamps are hard-wired in place. Typically, lighting extrusions are materials that are formed to produce a specific cross-sectional profile for a lighting fixture. Such extrusions can be created specifically to fit the desired shape of the light and enable a designer to easily place lights exactly where they are required without the need for larger, more obtrusive, traditional light fixtures.

Lighting extrusions are elongated pieces of material with a consistent cross-sectional profile. In many instances, these are elongated aluminum extrusions with a space for holding LED lights that span the length of the troffer. Troffers may be mounted to or suspended from ceilings, walls, floors, etc. In many cases, the extrusions are recessed into the ceiling, with the back side of the extrusion protruding into the ceiling.

When an LED lighting fixture with a unique or customized shape is desired, lighting extrusions are not often used, due to the difficulty involved in working a metal extrusion into a desired shape. Currently to create such luminaires, all items must be custom manufactured, cut, welded etc. per each specific luminaire. Therefore, even though lighting fixture aluminum extrusions meet some of the needs of the market, the above-noted drawbacks lessen the usability and user-friendliness of the existing devices in unique or custom applications. Current lighting fixture aluminum extrusions do not provide a convenient means of integrating linear LED strip lights into an LED lighting fixture that is customized in shape.

As a result of the previously recognized issues, a need exists for more efficient methods and systems for providing LED lighting fixtures using extrusions that may be customized in shape.

BRIEF SUMMARY

Illustrative embodiments of the disclosure are generally directed to an LED lighting fixture system using aluminum extrusions. The LED lighting fixture system provides a shape customizable lighting fixture. The system comprises a planar opaque top element and an opposing planar translucent bottom element that can be custom fabricated to take any number of shapes. Upon fabrication of the top and bottom elements into a custom shape, for example, a first aluminum extrusion is fitted to the left side, and a second aluminum extrusion is fitted to the left side. The first and second extrusions adapt to the shapes of the top and bottom elements. The extrusions comprise a first channel on the interior surface configured to accept the top element, and a second channel configured to accept the bottom element. A first end cap couples to a first end of the first and second extrusions. A second end cap couples to a second end of the first and second extrusions. An LED strip is operational on an interior surface of the top element.

Additional aspects of the claimed subject matter will be set forth in part in the description which follows, and in part will be obvious from the description, or may be learned by practice of the claimed subject matter. The aspects of the claimed subject matter will be realized and attained by means of the elements and combinations particularly pointed out in the appended claims. It is to be understood that both the foregoing general description and the following detailed description are exemplary and explanatory only and are not restrictive of the disclosed subject matter, as claimed.

BRIEF DESCRIPTION OF THE DRAWINGS

The accompanying drawings, which are incorporated in and constitute part of this specification, illustrate embodiments of the claimed subject matter and together with the description, serve to explain the principles of the claimed subject matter. The embodiments illustrated herein are presently preferred, it being understood, however, that the claimed subject matter is not limited to the precise arrangements and instrumentalities shown, wherein:

Like reference numerals refer to like parts throughout the various views of the drawings.

DETAILED DESCRIPTION

Figure 1:
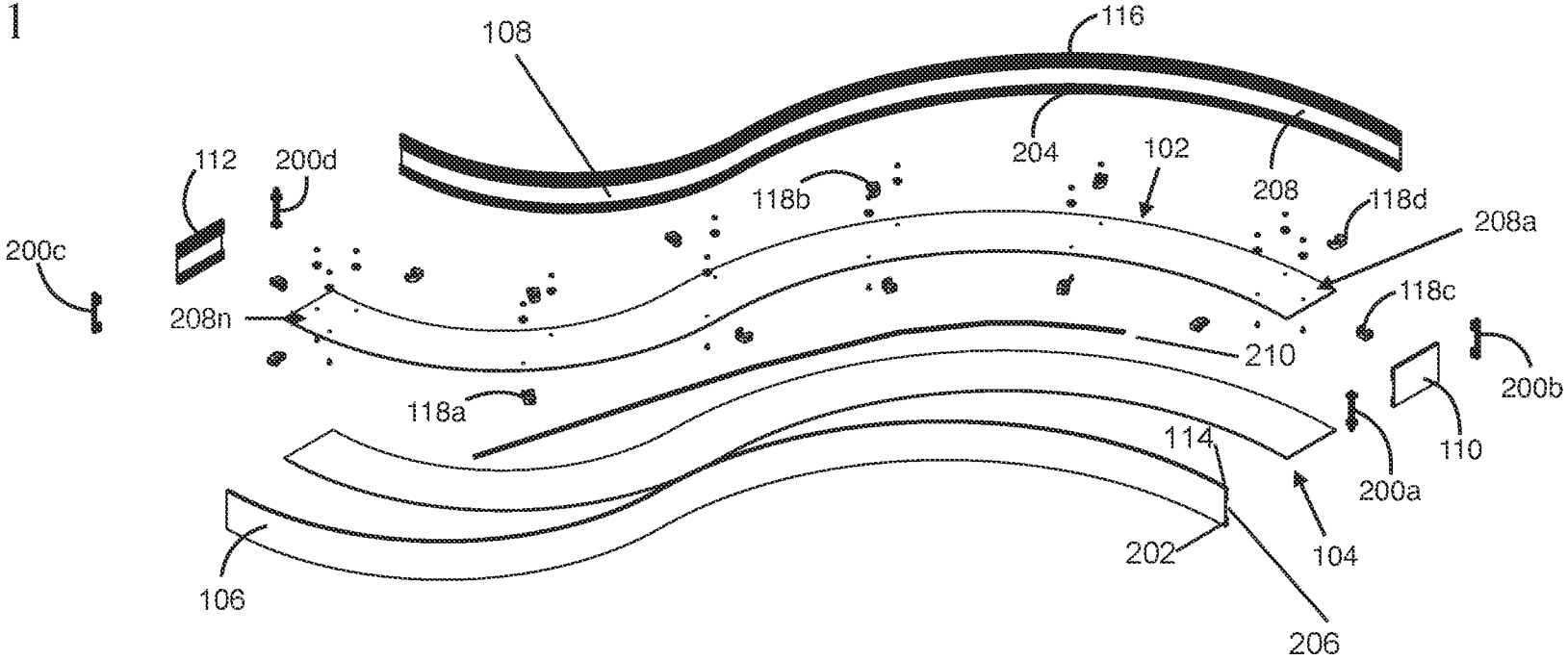
FIG. 1 illustrates an exploded view of the LED lighting fixture system using aluminum extrusions, in accordance with an exemplary embodiment.

The disclosed embodiments improve upon the issues identified within the prior art by providing a system that allows for quick and easy fabrication and installation of an LED lighting fixture with extrusions with a custom shape and/or size. Additionally, the claimed embodiments allow for efficient and speedy maintenance and upkeep of the device. The disclosed embodiments also facilitate an easier and less arduous installation and maintenance process. When an LED lighting fixture with a unique or customized shape is desired, the claimed embodiments may be used, due to the ease with which the claimed extrusions may be worked into a desired shape. The above-noted advantages increase the usability and user-friendliness of the claimed embodiments in unique or custom applications. The disclosed embodiments provide a convenient means of integrating linear LED strip lights into an LED lighting fixture that is customized in shape. Further, the disclosed embodiments provide a system which allows the creation of custom luminaires using standard extrusions that are disclosed herein.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the claimed embodiments as oriented in the figures. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An LED lighting fixture system 100 using aluminum extrusions is referenced in FIGS. 1-7. The LED lighting fixture system 100, hereafter "system 100" provides a unique lighting fixture that is customizable in shape and/or dimension and may also be easily adapted to achieve a desired shape. The system 100 utilizes a planar opaque top element 102, and an opposing planar translucent bottom element 104. Both top and bottom elements 102, 104 are custom shaped, meaning that they may have any shape. This includes a geometrical shape, such as a rectangle or circle, or an irregular shape, such as the shape shown in FIG. 1, which is a wave or a squiggly line shape. An LED strip 210 is operatively placed into the top element 102 for providing illumination. The bottom element 104 is translucent to enable passage of the light from the LED strip 210.

Working in conjunction with the top and bottom elements 102, 104 are a first and second aluminum extrusion 106, 108. The extrusions 106, 108 couple to opposing left and right sides of the top and bottom elements 102, 104. Thus, the extrusions 106, 108, with corresponding first and second end caps 110, 112, form a lighting fixture enclosure. Such an enclosure creates an elegant and convenient means of integrating linear LED strip lights in a protected and concealed rigid aluminum housing.

The first and second extrusions 106, 108 may be composed of a metal, such as aluminum, that enable the extrusions 106, 108 to conform to the shape of the top and bottom elements 102, 104 when it is bent in the appropriate way to conform to that shape. Alternatively, the first and second extrusions 106, 108 may be composed of material, such as rubber or another polymer, that enable the extrusions 106, 108 to more easily conform to the shape of the top and bottom elements 102, 104. This adaptable structure enables the system 100 to be placed in variously sized and shaped light fixture receptacles requiring illumination.

As shown in FIG. 1, the system 100 comprises a planar opaque top element 102 that forms the top barrier of the system 100. The top element 102 orients upwardly, or away from an opposing planar translucent bottom element 104, described below. However, the term "top" is relative, the system 100 can be oriented as a light fixture in ceilings, walls, and the ground. The top element 102 is opaque, such that light cannot pass through. This allows light to pass through other directions.

In one possible embodiment, the planar opaque top element 102 has an irregular circumferential shape. Thus, the circumference of the curved geometric top element 102 is not linear or a simple geometry, such as a circle or square. Rather, irregular shapes, such as a wave, an S-shape, or a multi-curved shape may be used. Thus, the irregular circumferential shape of the first extrusion 106 defines a particular irregular shape, such as an S-shape (see FIG. 2). Those skilled in the art will recognize that such a shape is aesthetic and increases the surface area for an LED strip 210, so as to maximize lighting. An irregular circumferential shape is a shape that is not a geometric shape and that may include multiple curves.

Opposing the top element 102 is a planar translucent bottom element 104. The bottom element 104 has a translucent configuration that enables passage of light from the LED strip 210 held on the interior. Various color filters can be applied to the bottom element 104 to enable the LED strip 210 to emit different colors and patterns through the bottom element 104. In one possible embodiment, the translucent bottom element 104 comprises a plastic material.

In some embodiments, the bottom element 104 has an identical circumferential shape to the circumferential shape of the top element 102. Thus, if the top element 102 is wave-shaped, the bottom element 104 has an identical wave shape. It is significant to note that both the top and bottom elements 102, 104 are customizable. In this manner, any number of shapes and sizes for the top and bottom elements 102, 104 may be used to accommodate different buildings, ceilings, and other light fixture frameworks.

Looking again at FIG. 1, the system 100 provides a first extrusion 106 disposed on a left side of the system 100, between the top and bottom elements 102, 104. The first extrusion 106 may be coupled to both the top and bottom elements 102, 104 while on the left side. However, as discussed above, since the system 100 can be oriented in multiple directions, the term "left" is relative. In any case, the first extrusion 106 helps provides form to the system 100, helping to stabilize the top and bottom elements 102, 104 in a parallel relationship.

In one non-limiting embodiment, the first extrusion 106 comprises an aluminum material. The aluminum material enables greater flexibility to the first extrusion 106, so as to conform to the top and bottom elements 102, 104, as described below. However, other malleable or flexible materials may also be used. In some embodiments, the first extrusion 106 adapts to the shapes of the planar opaque top element 102 and the planar translucent bottom element 104, which may include a color. This adaptation to the shapes can be through simply bending the aluminum metal manually, or with a bending tool known in the art of metal working.

In yet another example of the first extrusion 106 conforming to the irregular shapes of the top and bottom elements 102, 104, a precast mold of the first extrusion 106 that matches the shapes and sizes of the top and bottom elements 102, 104 can be used. Once the mold is filled with a fluid material, the first extrusion 106 has the same dimensions as the top and bottom elements 102, 104. In this manner, it is advantageous to fabricate the first extrusion 106 from aluminum, or other pliable materials known in the art of light fixtures. Additionally, anodized aluminum may also be used to fabricate the extrusions.

In some embodiments, the first extrusion 106 comprises a first channel 114 on its interior surface 206. The first channel 114 may include a ridge that forms a snap-fit relationship with correlating ridges in the top and bottom elements 102, 104. In one non-limiting embodiment, the first channel 114 is configured to accept the top element 102. Similarly, the first extrusion 106 comprises a second channel 202 on its interior surface, 206 below the first channel 114, the second channel is configured to accept the bottom element 104. This allows the first extrusion 106 to couple to the top and bottom elements 102, 104 after adapting to their shapes and sizes. As illustrated, both the first and second channel 114, 202 run parallel to each other. The channels may be simple linear channels, or more intricate channels with flanges, ridges, depressions, and other ornamental and heat dissipating shapes.

In some embodiments, the channels 114, 202 may form flanges, right angles, and depressions to enable a sliding, lockable relationship with the top and bottom elements. Such irregularly shaped channels (see FIG. 5 for example) can work as heat sinks to improve the heat management of LED strips, and as an LED strip diffuser to set creative lighting effects and assist LED strip installation.

Figure 2:
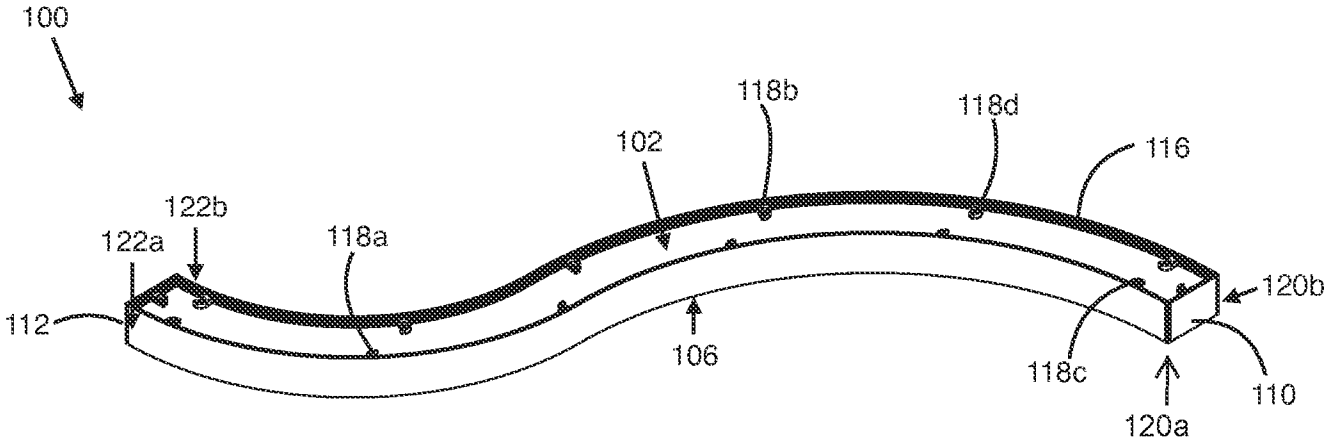
FIG. 2 illustrates a perspective view of an exemplary LED lighting fixture system using aluminum extrusions, in accordance with an exemplary embodiment.

As referenced in FIG. 2, a second extrusion 108, identical to the first extrusion 106, resides on the right side of the system 100. Thus, the first extrusion 106 is disposed on the left side, and the second extrusion 108 is disposed on the opposite right side of the top and bottom elements 102, 104 (see FIG. 1). Similar to the first extrusion 106, the second extrusions 108 can be manually conformed to match the shapes of the opaque top element 102 and the translucent bottom element 104. In one non-limiting embodiment, the irregular circumferential shape of the second extrusion 108 defines a wave-shape. This creates an enclosure defined by an irregular shape. Such a lighting enclosure provides an elegant and convenient means of integrating linear LED strip lights in a protected and concealed rigid aluminum housing.

In some embodiments, the second extrusion 108 comprises a first channel 116 on an interior surface 208. The first channel 116 may include a ridge that forms a snap-fit relationship with correlating ridges in the top and bottom elements 102, 104. In one non-limiting embodiment, the first channel 116 is configured to accept the top element 102. The second extrusion 108 may also include a second channel 204 that extends along the interior surface 208, below the first channel 116. The second channel 204 is configured to couple to the bottom element 104. As illustrated, both the first and second channels 116, 204 run parallel to each other.

As discussed above, the first and second extrusions 106, 108 detachably couple to the top and bottom elements 102, 104, forming an at least partially enclosed lighting fixture. Various fastening means may be used enable coupling in such a manner. In one possible embodiment, the first and second extrusions 106, 108 form multiple fastening holes 208*a*, 208*n* that are sized and dimensioned to enable passage of at least one fastener. The fastening holes 208*a*, 208*n* are configured to enable connectivity between the extrusions to the top and bottom elements 102, 104, and the end caps, discussed below. The fasteners 118*a-d* may include, without limitation, a clip, a threaded screw, a bolt, a nail, a magnet, an adhesive, and a mechanical snap-fit means.

Looking again at FIG. 2, the system 100 includes a first end cap 110 that is configured to be coupled to a first end 120*a*, 120*b* of the first and second extrusions 106, 108, respectively. The first end cap 110 may include a square shaped panel that fits to the terminus of the elements and extrusions. Opposite the first end cap 110 is a second end cap 112 that is configured to be coupled to a second end 122*a*, 122*b* of the first and second extrusions 106, 108.

In some embodiments, the first and second caps 110, 112 are substantially similar, having a flat, square or rectangular shape. The end caps 110, 112 are configured to form multiple fastening holes. The fastening holes are configured to enable connectivity between the end caps 110, 112 to the extrusions 106, 108 and top and bottom elements 102, 104. In one non-limiting embodiment, the fastening holes are sized and dimensioned to enable passage of the at least one fastener 118*a-d*.

In one possible embodiment of the system 100, multiple corner brackets 200*a*, 200*b*, 200*c*, 200*d* couple to the ends 120*a-b*, 122*a-b* in order to strengthen the connection between the elements 102, 104 and the extrusions 106, 108. The corner brackets 200*a-d* are configured to help fasten the first and second end caps 110, 112 to the first end 120*a-b* of the first and second extrusions 106, 108 and the second end 122*a-b* of the first and second extrusions 106, 108, respectively. However, in alternative embodiments, no corner brackets are used; and rather, the elements 102, 104 and the extrusions 106, 108 directly attach to each other and the end caps 110, 112.

In some embodiments, a fastening tool (not shown) may be utilized to introduce the at least one fastener 118*a-d* into the fastening holes 208*a*, 208*b*. The fastening tool may include, without limitation, a screwdriver, an Allen wrench, a torque screw, and other fastening means known in the art. The fastening tool rotatably drives the fastener into the side of the first and second extrusions 108 and/or the top and bottom elements 102, 104.

To enable illumination from the system 100, an LED strip 210 is placed on an interior surface of the planar opaque top element 102. The LED strip 210 may extend across the longitudinal of the top element 102. The LED strip 210 can fasten to the top element 102 through a snap fit relationship, or fasteners, or a magnetic connection. In other embodiments, the LED strip 210 may be a flexible strip of light, having any number of colors, lighting patterns, watts, and other variables known in the art of lighting.

In some embodiments, the system 100 may also provide a circuitry that is operatively connected to the LED strip 210. The circuitry provides sufficient electrical power to achieve lighting in the LED strip 210. In some embodiments, the circuitry regulates power to the LED strip 210, so as to prevent power outages, static electricity, or electrical harm during operation or maintenance of the system 100. In one non-limiting embodiment, the circuitry includes wiring, resistors, circuits, and other electronic components known in the art of lighting fixtures.

Figure 3:
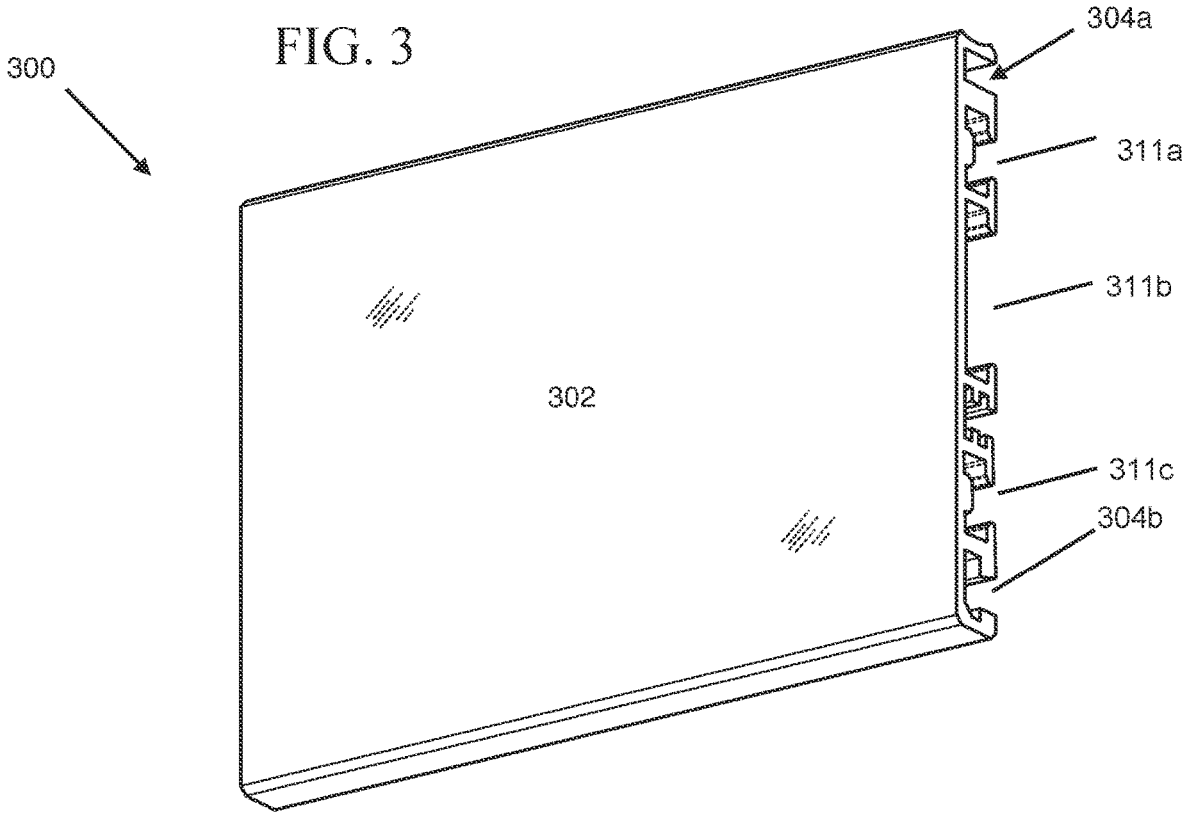
FIG. 3 illustrates a perspective view of the exterior side for an exemplary rectangular shaped first extrusion, in accordance with an exemplary embodiment.

As discussed above, the first and second extrusions adapt to the shape of the top and bottom elements 102, 104. While a wave shape has been discussed above, other shapes and dimensions may also be used. As shown in FIG. 3, a first extrusion 300 may have a flat, elongated, rectangular shape. A corresponding second extrusion 700, referenced in FIGS. 5-7, also has an identical flat, elongated, rectangular shape. Thus, the first and second extrusions 300, 700 have a generally rectangular shape that adapts to the rectangular shape of a top element and a bottom element. The rectangular-shaped first extrusion 300 positions on the left side of the system, between the top and bottom elements 102, 104.

Figure 4:
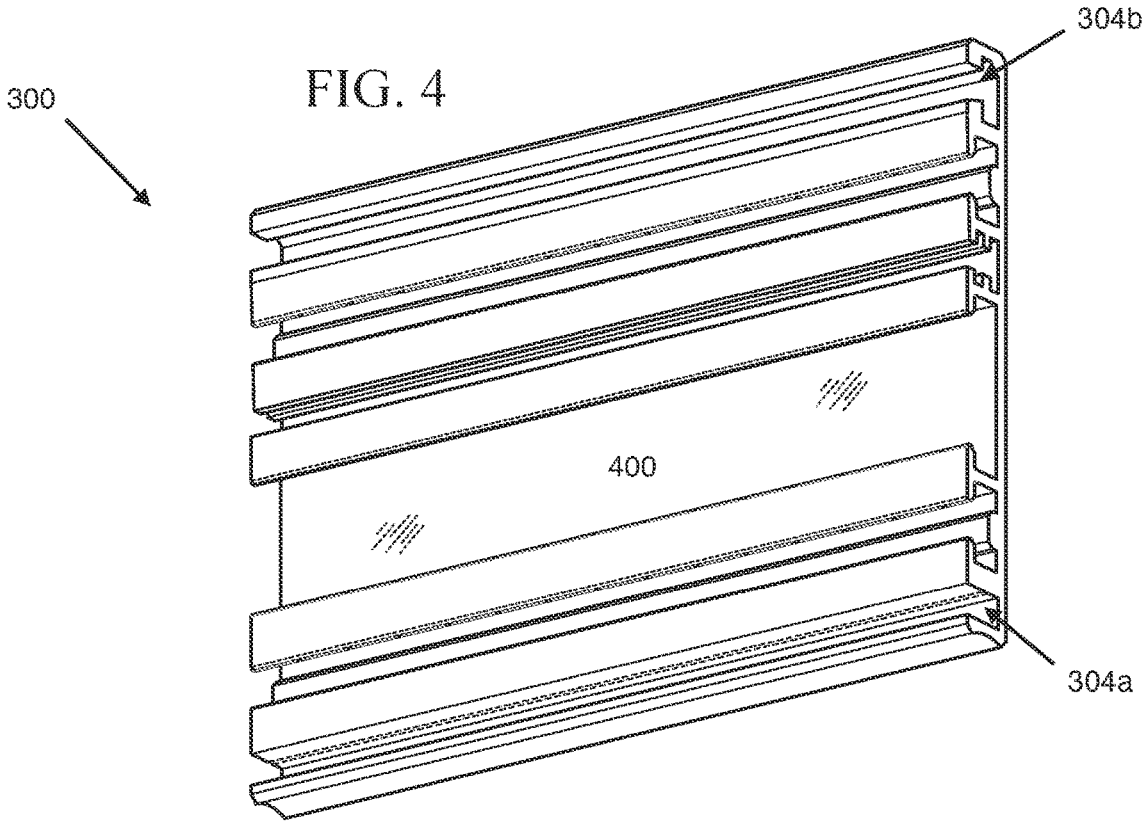
FIG. 4 illustrates a perspective view of the interior side for the rectangular shaped first extrusion shown in FIG. 3, in accordance with an exemplary embodiment.

And similar to the wave-shaped extrusion, the first extrusion couples to both the top and bottom elements 102, 104 while on the left side. In additional embodiments, the second extrusion 500 couples to the opposite right side, while also adapting to the rectangular shape of the top and bottom elements. In some embodiments, the first extrusion 300 includes an exterior side 302 that is flat. FIG. 4 shows first extrusion 300 having an interior side 400 that forms at least one first channel 304*a* for connecting to the top element; and a spaced-apart, parallel second channel 304*b* for connecting to the bottom element. The channels 304*a-b* may form flanges, right angles, and depressions to enable a sliding, lockable relationship with the top and bottom elements. It is understood that other channels in the first extrusion 300 may be used to connect to the top and bottom elements, such as channels 311*a*, 311*b* and 311*c*.

FIG. 3 further shows that the interior side 400 that forms a channel 311*a* for connecting to the corner piece (described in more detail below); and a spaced-apart, parallel channel 311*c*, also for connecting to the corner piece. The channels 311*a* and 311*c* may form flanges, right angles, and depressions to enable a sliding, lockable relationship with the corner piece. Also, 311*a* and 311*c* may form channels that have overhanging free edges that include a flat surface that faces towards the exterior side 302. This allows for certain portions of the corner piece (described in more detail below) to be slid into said channels, such that said certain portions of the corner piece cannot be removed from said channels when an outward force is applied, wherein said force is directed away from, and perpendicular to, the exterior side 302. FIG. 3 further shows that the interior side 400 forms a channel 311*b* for connecting to the corner piece. 311*b* may also form a channel with overhanging free edges that include a flat surface that faces towards the exterior side 302.

Figure 5:
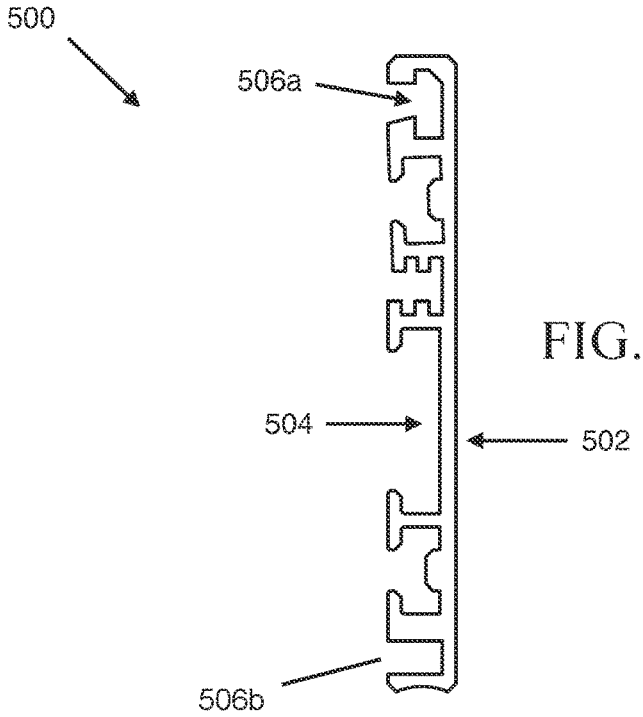
FIG. 5 illustrates a side view of an exemplary rectangular shaped second extrusion, in accordance with an exemplary embodiment.
Figure 6:
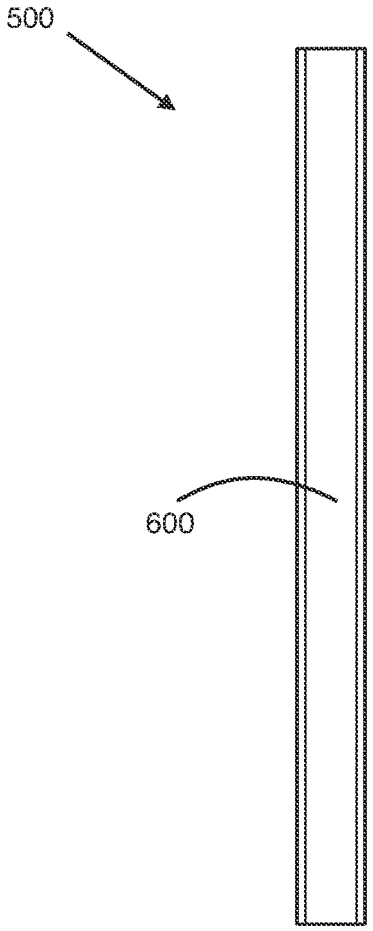
FIG. 6 illustrates a top view of the rectangular shaped second extrusion shown in FIG. 5, in accordance with an exemplary embodiment.
Figure 7:
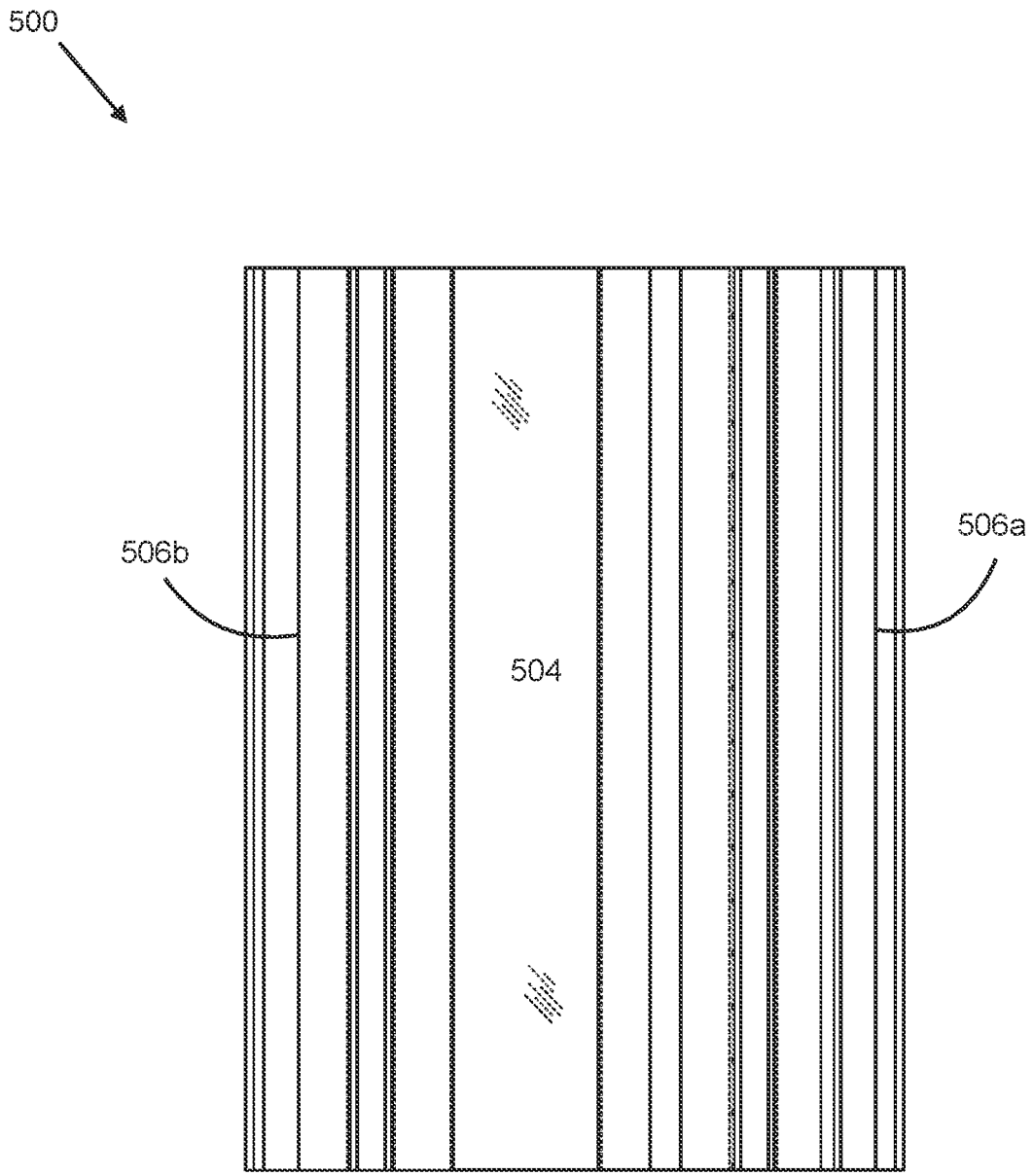
FIG. 7 illustrates a rear view of an interior side of the rectangular shaped second extrusion shown in FIG. 5, in accordance with an exemplary embodiment.

FIG. 5 shows an interior side 504 of the second extrusion 500 having multiple channels 506*a*, 506*b* with sloped flanges and curved surfaces to enhance the connectivity with the top and bottom elements. For example, the channels 304*a-b* define ridges and irregular surfaces that slide onto, or form a snap-fit or friction fit relationship with, their respective top or bottom elements. FIG. 6 illustrates a perimeter edge 600 of the second extrusion 500. FIG. 7 another view of the interior side 502 for the second extrusion 500, showing channels 506*a*, 506*b*. Note that extrusion 500 may also include the channels 311*a*, 311*b* and 311*c*, which are commensurate with the same channels in extrusion 300.

In operation, the top and bottom elements are molded into a desired irregular circumference shape. This may include a wavelike shape, as illustrated in FIGS. 1-2. Such a wave shape is aesthetic and increases the surface area for an LED strip, so as to maximize lighting. An LED strip couples to the interior surface of the top element. A circuitry may also be attached to power the LED strip. The bottom element is translucent so as to enable passage of the light generated by the LED strip.

After the top and bottom elements are in their final shape, and the LED strip attached for operation, a first extrusion and a second extrusion are shaped to be similar to the top and bottom elements. The extrusions are then coupled to the left and right side of the elements, so as to form an enclosure. Channels on the extrusions enable facilitated connectivity, therebetween. End caps may also be applied to the termini of the elements and extrusions. Various fasteners can be driven through fastening holes in the extrusions to secure the top and bottom elements and end caps to enable efficient and ornamental illumination from the LED strip.

In one embodiment, the section of first extrusion 300 and second extrusion 500 shown in FIGS. 3-7 is precisely the first and second end caps 110, 112. That is, the first and second end caps 110, 112 are simply sections of the first extrusion 300 and second extrusion 500 that have been cut to the length needed for the end caps 110, 112. That is, in this embodiment, the first extrusion 300, second extrusion 500, end cap 110 and end cap 112 are all cut form the same extrusion, and therefore all of the aforementioned items have the same or identical cross sections.

Figure 11:
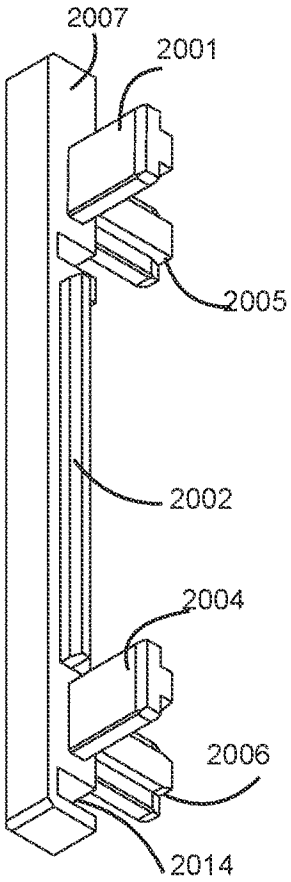
FIG. 11 illustrates a front perspective view of the corner bracket shown in FIG. 8, in accordance with an exemplary embodiment.
Figure 10:
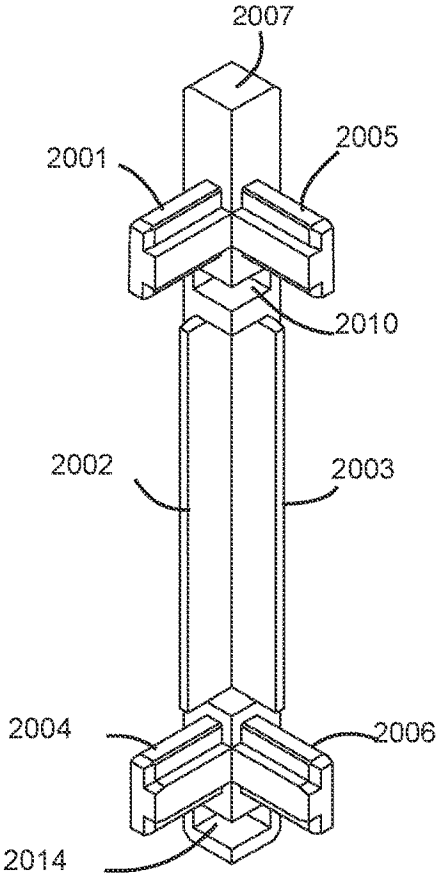
FIG. 10 illustrates a side perspective view of the corner bracket shown in FIG. 8, in accordance with an exemplary embodiment.
Figure 9:
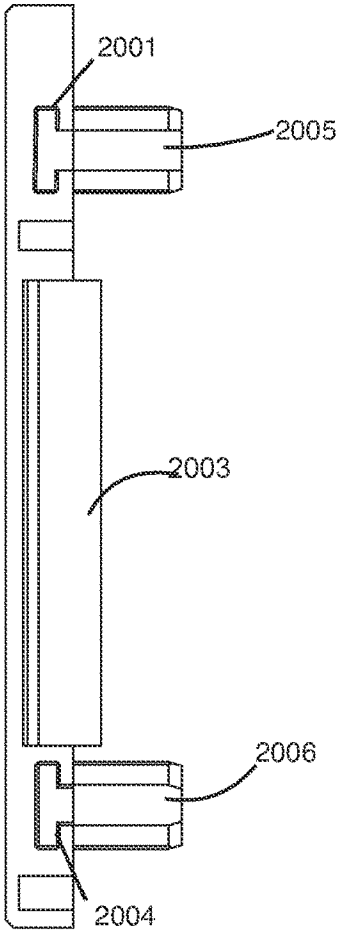
FIG. 9 illustrates a front view of the corner bracket shown in FIG. 8, in accordance with an exemplary embodiment.
Figure 8:
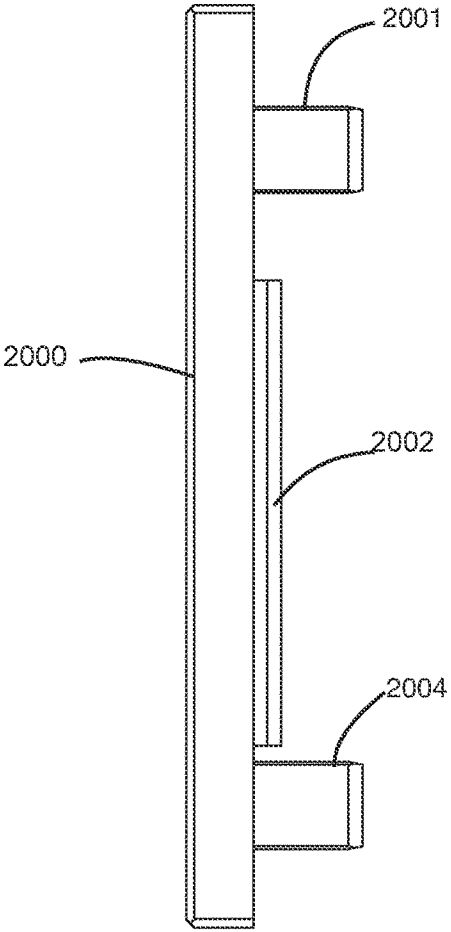
FIG. 8 illustrates a left side view of a corner bracket for the LED lighting fixture system, in accordance with an exemplary embodiment.

The corner brackets 200*a*, 200*b*, 200*c*, 200*d* will now be described with reference to FIGS. 8-11. FIG. 8 illustrates a left side view of a corner bracket for the LED lighting fixture system, in accordance with an exemplary embodiment, while FIG. 9 illustrates a front view of the corner bracket, FIG. 10 illustrates a side perspective view of the corner bracket, and FIG. 11 illustrates a front perspective view of the corner bracket.

FIGS. 8-11 show that the corner piece 200*a* includes a shaft 2000 having a flange 2001 extending perpendicular to the shaft, the flange 2001, located at the top 2007 of the corner piece, shaped and sized to fit securely within the channel 311*a* of the end cap 110. The corner piece also includes a flange 2005, located at the top 2007 of the corner piece, extending perpendicular to the shaft and perpendicular to the flange 2001, the flange 2005 also shaped and sized to fit securely within the channel 311*a* of the first extrusion 106. The corner piece also includes a flange 2004, located at the bottom of the corner piece, extending perpendicular to the shaft and parallel to the flange 2001, the flange 2004 also shaped and sized to fit securely within the channel 311*c* of the end cap 110. The corner piece also includes a flange 2006, located at the bottom of the corner piece, extending perpendicular to the shaft and perpendicular to the flange 2004, the flange 2006 also shaped and sized to fit securely within the channel 311*c* of the first extrusion 106.

The corner piece also includes an elongated flange 2002, located at the center of the corner piece, extending perpendicular to the shaft and parallel to the flange 2001, the flange 2002 also shaped and sized to fit securely within the channel 311*b* of the end cap 110. The corner piece also includes an elongated flange 2003, located at the center of the corner piece, extending perpendicular to the shaft and parallel to the flange 2005, the flange 2003 also shaped and sized to fit securely within the channel 311*b* of the first extrusion 106.

In this way, the corner piece can be used to connect the end cap 110 to the first extrusion 106. Due to the congruence of the first and second extrusions, and the end caps 110, 112, the corner piece can also be used to connect the end cap 110 to the second extrusion 108, to connect the end cap 112 to the second extrusion 108, and to connect the end cap 112 to the first extrusion 106.

FIGS. 8-11 also show an indentation 2010 below the flanges 2001 and 2005. This corner shaped indentation is meant to accommodate the corner of the planar opaque top element 102 at the juncture of the end cap 110 and the first extrusion 106. FIGS. 8-11 also show an indentation 2014 below the flanges 2004 and 2006. This corner shaped indentation is meant to accommodate the corner of the translucent bottom element 104 at the juncture of the end cap 110 and the first extrusion 106.

Figure 13:
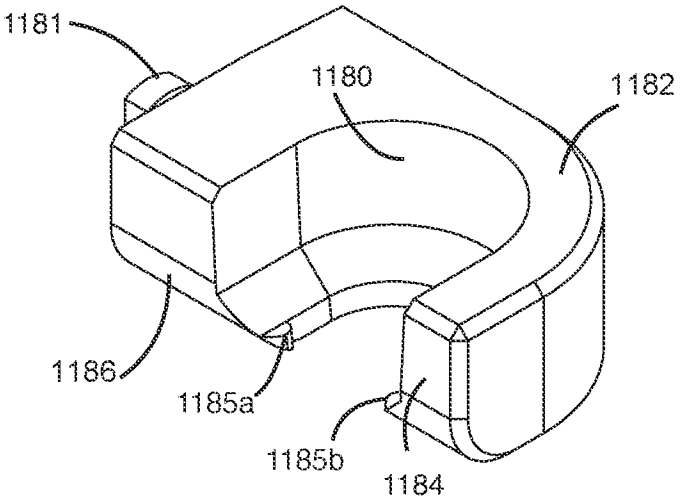
FIG. 13 illustrates a top perspective view of the fastener shown in FIG. 12, in accordance with an exemplary embodiment.
Figure 15:
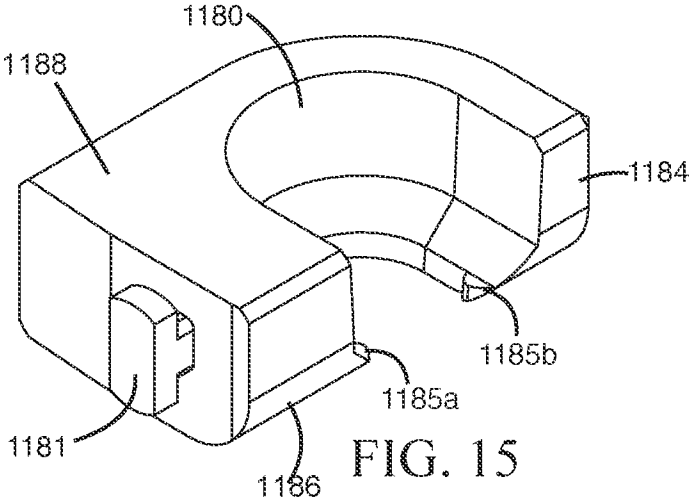
FIG. 15 illustrates a side perspective view of the fastener shown in FIG. 8, in accordance with an exemplary embodiment.
Figure 12:
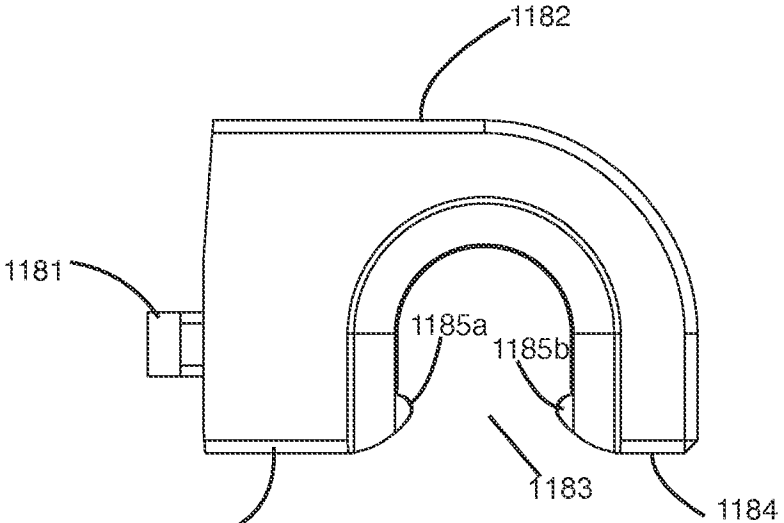
FIG. 12 illustrates a top view of a fastener for the LED lighting fixture system, in accordance with an exemplary embodiment.
Figure 14:
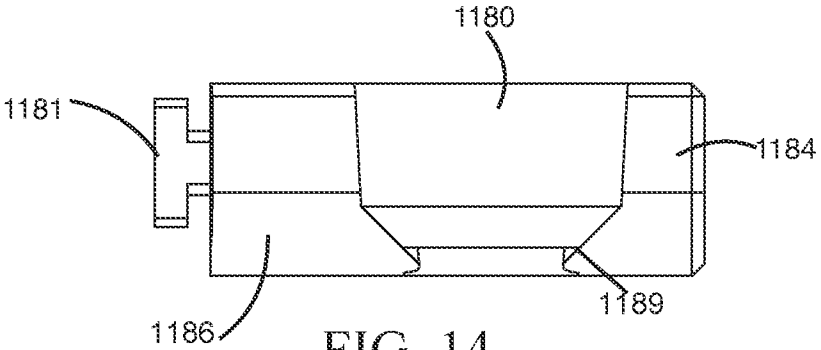
FIG. 14 illustrates a front view of the fastener shown in FIG. 8, in accordance with an exemplary embodiment.

The fasteners 118*a-d* will now be described with reference to FIGS. 12-15. FIG. 12 illustrates a top view of a fastener 118*a* for the LED lighting fixture system, in accordance with an exemplary embodiment, while FIG. 13 illustrates a top perspective view of the fastener, FIG. 14 illustrates a front view of the fastener and FIG. 15 illustrates a side perspective view of the fastener.

FIGS. 12-15 show that the fastener includes a roughly U-shaped element 1182, wherein the U-shaped element has an interior surface 1180 defining an orifice or cutout 1183. The U-shaped element extends from a proximal end 1186 to a distal end 1184. The interior surface 1180 of the U-shaped element 1182 includes a beveled inner edge 1189 that narrower at the bottom and widens towards the top. Two protrusions 1185*a*, 1185*b* located on either side of the narrowest part of the beveled inner edge 1189 extend into the orifice or cutout 1183.

The fastener also includes a flange 1181, located at the proximal end, extending away from the fastener, the flange 1181 also shaped and sized to fit securely within the channels 311*a*, 331*c*, or 304*b* of the first extrusion, second extrusion or end caps 110, 112. The fastener is configured so as to attach to a channel on the interior surface of the extrusion, such as at or near the channel 116 on an interior surface 208 of the second extrusion 108, as shown in FIGS. 1-2. The fastener is attached to the channel such that the surface 1188 of fastener faces the planar opaque top element 102. In this orientation, the beveled inner edge 1189 is wider adjacent to the top element 102 and narrows upwards. This arrangement provides a junction for removably coupling to a hanging element. That is, a hanging element, such as a wire hanging from a ceiling, may include a bulb or sphere at the end of the wire, wherein the bulb or sphere may be smaller than the largest diameter of the orifice 1183 (near the top element 102) but larger than the narrowest diameter of the orifice 1183. This allows the bulb or sphere to be slid into the orifice 1183 of the fastener when the fastener is attached to the first and second extrusions. The bulb or sphere may also be slid out of the orifice 1183 of the fastener. Thus, the hanging element may be removably attached to the fastener, which allows for quick and easy installation and removal of the claimed embodiments.

These and other advantages of the claimed embodiments will be further understood and appreciated by those skilled in the art by reference to the following written specification, claims and appended drawings.

Because many modifications, variations, and changes in detail can be made to the described preferred embodiments described herein, it is intended that all matters in the foregoing description and shown in the accompanying drawings be interpreted as illustrative and not in a limiting sense. Thus, the scope of the claimed embodiments should be determined by the appended claims and their legal equivalence.

Embodiments herein, for example, are described above with reference to block diagrams and/or operational illustrations of methods and systems, according to said embodiments. The functions/acts noted in the blocks may occur out of the order as described. For example, two steps described in succession may in fact be executed substantially concurrently or the steps may sometimes be executed in the reverse order, depending upon the functionality/acts involved.

While certain embodiments have been described, other embodiments may exist. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A custom LED lighting fixture system, the system comprising:

a planar opaque top element, the top element having an irregular circumferential shape;

a planar translucent bottom element, the bottom element having an identical circumferential shape to the circumferential shape of the top element;

a first extrusion comprising a planar flexible element, the first extrusion comprising a left side of an LED fixture, the first extrusion comprising:

a first channel on its interior surface, the first channel configured to accept the top element;

a second channel on its interior surface below the first channel, the second channel configured to accept the bottom element;

at least one channel between the first and second channels, said at least one channel configured for accepting a corner bracket;

a second extrusion identical to the first extrusion, the second extrusion comprising a right side of the LED fixture;

a first end cap configured to be coupled to a first end of the first and second extrusions;

a second end cap configured to be coupled to a second end of the first and second extrusions;

a plurality of corner brackets, said corner brackets configured for coupling the at least one channel of the first and second extrusions to the first and second end caps; and an LED strip placed on an interior surface of the top element.

2. The system of claim 1, wherein the irregular circumferential shape of the planar translucent bottom element defines a shape having multiple curves.

3. The system of claim 2, wherein the first and second extrusions adapt to the irregular circumferential shape of the planar opaque top element.

4. The system of claim 3, wherein the first and second extrusions adapt to the irregular circumferential shape of the planar translucent bottom element.

5. The system of claim 1, wherein the first extrusion comprises an aluminum material.

6. The system of claim 1, wherein the second extrusion comprises an aluminum material.

7. The system of claim 1, further comprising a circuitry operatively connected to the LED strip.

8. The system of claim 1, further comprising multiple fasteners configured to help fasten the first and second extrusions to the top and bottom elements.

9. The system of claim 1, wherein the translucent bottom element comprises a plastic material.

10. A custom LED lighting fixture system, the system comprising:

a planar opaque top element, the top element having an irregular circumferential shape;

a planar translucent bottom element, the bottom element having an identical circumferential shape to the circumferential shape of the top element;

a first extrusion comprising a planar element, the first extrusion comprising a left side of an LED fixture, the first extrusion comprising:

a first channel on its interior surface, the first channel configured to accept the top element;

a second channel on its interior surface below the first channel, the second channel configured to accept the bottom element;

at least one channel between the first and second channels, said at least one channel configured for accepting a corner bracket;

a second extrusion identical to the first extrusion, the second extrusion comprising a right side of the LED fixture;

a first end cap configured to be coupled to a first end of the first and second extrusions;

a second end cap configured to be coupled to a second end of the first and second extrusions;

a plurality of corner brackets, said corner brackets configured for coupling the at least one channel of the first and second extrusions to the first and second end caps;

a plurality of fasteners attached to the first and second extrusions, said plurality of fasteners configured to couple with a hanging element; and an LED strip placed on an interior surface of the top element.

11. The system of claim 10, wherein the irregular circumferential shape of the planar opaque top element defines a rectangular shape.

12. The system of claim 11, wherein the irregular circumferential shape of the planar translucent bottom element defines a rectangular shape.

13. The system of claim 12, wherein the first and second extrusions adapt to the rectangular shapes of the planar opaque top element.

14. The system of claim 13, wherein the first and second extrusions adapt to the rectangular shapes of the planar translucent bottom element.

15. The system of claim 10, wherein the first extrusion comprises an aluminum material.

16. The system of claim 10, wherein the second extrusion comprises an aluminum material.

17. The system of claim 10, further comprising a circuitry operatively connected to the LED strip.

18. A custom LED lighting fixture system, the system consisting of:

a planar opaque top element, the top element having an irregular circumferential shape;

a planar translucent bottom element, the bottom element having an identical irregular circumferential shape as the top element;

an anodized aluminum first extrusion comprising a planar element, the first extrusion comprising a left side of an LED fixture, the first extrusion defining a side of the irregular circumferential shape, the first extrusion comprising:

a first channel on its interior surface, the first channel configured to accept the top element;

a second channel on its interior surface below the first channel, the second channel configured to accept the bottom element;

at least one channel between the first and second channels, said at least one channel configured for accepting a corner bracket;

an anodized aluminum second extrusion identical to the first extrusion, the second extrusion comprising a right side of the LED fixture, the second extrusion defining a side of the irregular circumferential shape, whereby the first and second extrusions adapt to the irregular circumferential shape of the planar opaque top element and the planar translucent bottom element;

a first end cap configured to be coupled to a first end of the first and second extrusions;

a second end cap configured to be coupled to a second end of the first and second extrusions;

a plurality of corner brackets, said corner brackets configured for coupling the at least one channel of the first and second extrusions to the first and second end caps;

a plurality of fasteners attached to the first and second extrusions, said plurality of fasteners configured to couple with a hanging element; and an LED strip placed on an interior surface of the top element.

* * * * *